US005368393A

United States Patent [19]

Normann

[11] Patent Number: 5,368,393

[45] Date of Patent: Nov. 29, 1994

[54] HANDLE FOR PLASTIC BAGS

[76] Inventor: J. Brian Normann, 1900 S. Eads St., Apt. 725, Arlington, Va. 22202

[21] Appl. No.: 79,732

[22] Filed: Jun. 22, 1993

[51] Int. Cl.[5] ..... B65D 33/06; A45F 5/10

[52] U.S. Cl. ..... 383/13; 383/6; 294/170; 294/171

[58] Field of Search ..... 383/13, 25, 71, 6; 294/170, 171; 16/114 R, 114 B

[56] References Cited

U.S. PATENT DOCUMENTS

| | | | |
|---|---|---|---|
| 399,180 | 3/1889 | Bridwell . | |
| 609,946 | 8/1898 | Pusey . | |
| 1,226,403 | 5/1917 | Snyder . | |
| 1,512,053 | 10/1924 | Ridlinghafer . | |
| 1,538,022 | 5/1925 | Brekke . | |
| 1,564,101 | 12/1925 | Nakamura . | |
| 1,618,854 | 2/1927 | Worth . | |
| 1,675,439 | 7/1928 | Wolf . | |
| 2,023,098 | 12/1935 | Poyer . | |
| 2,041,691 | 5/1936 | Becklin . | |
| 2,272,854 | 2/1942 | Sloane et al. . | |
| 2,287,329 | 6/1942 | Santa Maria et al. . | |
| 2,394,050 | 2/1946 | Goza . | |
| 2,448,894 | 9/1948 | Laus . | |
| 2,460,915 | 2/1949 | Allen . | |
| 2,519,186 | 8/1950 | Herbert et al. . | |
| 2,522,833 | 9/1950 | Maccaferri . | |
| 2,528,239 | 10/1950 | McVay . | |
| 2,684,797 | 7/1954 | Schulte . | |
| 2,778,555 | 1/1957 | Poryle | 294/137 X |
| 2,800,940 | 7/1957 | Riesebeck . | |
| 2,846,714 | 8/1958 | Charlick . | |
| 2,852,114 | 9/1958 | Heit . | |
| 3,102,446 | 9/1963 | Raleigh . | |
| 3,207,397 | 9/1965 | Wilson . | |
| 3,306,507 | 2/1967 | Wilson . | |
| 3,321,798 | 5/1967 | Plamondon . | |
| 3,486,684 | 12/1969 | Dills et al. . | |
| 3,800,361 | 4/1974 | Stauffer . | |
| 3,913,172 | 10/1975 | Richards et al. . | |
| 4,091,497 | 5/1978 | Bade . | |
| 4,112,542 | 9/1978 | Snyder . | |
| 4,298,999 | 11/1981 | Mackey . | |
| 4,590,640 | 5/1986 | Enersen . | |
| 4,841,596 | 6/1989 | Fink . | |
| 4,902,060 | 2/1990 | Nobakht . | |
| 5,029,926 | 7/1991 | Dieterich, Jr. . | |
| 5,060,998 | 10/1991 | Phillips | 294/170 X |

FOREIGN PATENT DOCUMENTS

| | | | |
|---|---|---|---|
| 0446796 | 5/1936 | United Kingdom | 383/6 |
| 0446805 | 5/1936 | United Kingdom | 383/25 |
| 9111368 | 8/1991 | WIPO | 383/13 |

*Primary Examiner*—Allan N. Shoap
*Assistant Examiner*—Jes F. Pascua
*Attorney, Agent, or Firm*—Penros Lucas Albright

[57] ABSTRACT

A handle for plastic bags which include carrying loops, the handle composed of molded or extruded material having two transverse grooves and/or a longitudinal groove, each groove having a wide mouth, inwardly extending converging sides leading to a narrow channel and an enlarged opening thereafter. The handle having closure means at each end which may form other functions such as a whistle or flashlight. Transverse cavities are optionally formed on the upper and lower sides near ends of the body for receiving perpendicular thereto handles having similar cavities for interlocking therewith.

9 Claims, 1 Drawing Sheet

HANDLE FOR PLASTIC BAGS

FIELD OF THE INVENTION

The invention relates to handles for holding and carrying plastic shopping bags, which include carrying loops.

BACKGROUND OF THE INVENTION

Many retail establishments, such as grocery stores, provide inexpensive plastic shopping bags to customers for the purpose of carrying their purchases therefrom, frequently to their automobiles in nearby parking lots. The bags are then placed in their automobiles and taken to the purchasers' homes. Here, the shopping bags, filled with the purchased materials and articles, are removed from the automobiles and carried by hand into the homes—if food, usually into the kitchens of the occupants. Although plastic bags of this type are relatively strong, the carrying loops or straps thereof tend to dispose themselves in a manner that concentrates the weight of the shopping bags' contents over a small area of the palm or the fingers or both of the person carrying the bags. The straps may thus bite into or crease the hand and fingers where they bear against it, causing discomfort and pain.

Problems incident to carrying plastic shopping bags are well known, and a number of solutions have been proposed which include the provision of various types of handles for the bags.

Such devices are disclosed in the following Patents: U.S. Pat. No. 1,512,053 of Ridlinghafer, U.S. Pat. No. 1,564,101 of Nakamura, U.S. Pat. No. 2,287,329 of Maria et al., U.S. Pat. No. 2,448,894 of Laus, U.S. Pat. No. 2,460,915 of Allen, U.S. Pat. No. 2,519,186 of Herbert et al, No. 2,684,797 of Schulte, U.S. Pat. Nos. 3,207,397 and 3,306,507 of Wilson, U.S. Pat. No. 3,800,361 of Stauffer, U.S. Pat. No. 4,590,640 of Enersen, U.S. Pat. No. 4,841,596 of Fink, U.S. Pat. No. 4,902,060 of Nobakht, and U.S. Pat. No. 5,029,926 of Dieterich, Jr.

For the most part, the foregoing patents disclose a variety of prior art handles which have slots for receiving the loops for carrying the bags which are disposed longitudinally relative to the length of the handle, that is, parallel to the handles' longitudinal axes. Other handles, such as disclosed in the aforesaid patents to Ridlinghafer, Wilson, and Fink, disclose transverse slots for receiving the loops of the plastic bags. Whereas these latter handles serve the purposes intended, they entail certain disadvantages. For example, the market-bag carrier of Ridlinghafer requires the provision and application of a separate strip to secure the bags' loops. The transverse grooves of Wilson's carrying bags are not well adapted to facilitate insertion of the plastic bags' carrying loops therein. The handles of Fink have shaped recesses to facilitate receipt as well as to support the bags' straps, but the overall configurations add to manufacturing costs and they are not well adapted for being readily dispensed by harried cashiers. The configurations are also not well suited for receiving printed matter or advertising, in contrast to the carrying handles of Wilson. Accordingly, a need exists for a convenient, practical handle for plastic bags which, at the same time, is relatively simple, but dependable for the intended use, and which further provides marketing advantages and attractions whereby retailers find it advantageous to stock, dispense and use with their plastic bags.

SUMMARY OF THE INVENTION

In its simplest form, the handle in accordance with the invention comprises a length of PVC tubing into which are formed, perpendicular to the longitudinal axis of the tubing, two V-shaped slots which terminate in circular openings. The circular openings are provided on each side of the slots, and each corresponding pair of circular openings disposed near the same end of the handle have a common transverse axis which is perpendicular to the longitudinal axis of the PVC tubing. Moreover, the transverse axes of both corresponding pairs, which are parallel, approximately intersect the handle's longitudinal axis. Closures having disc-like portions and inwardly extending plugs are also provided which may serve a variety of functions. Although in a preferred embodiment, the tubing is of a circular cross section. In other preferred embodiments, the cross sections are substantially square, or the tube from which the handle is formed can be extruded so that the resulting handle may be provided not only with the transverse slots, but also may include a longitudinal slot with a continuous mouth extending along the top of the handle of a groove that has a cross section similar to that of the transverse slots.

To enhance the attractiveness of the handles to the merchandisers, they are provided with ample clear surface areas for printed matter or advertising, and, in further embodiments transverse notches or cavities are provided near the ends of the tubing which cooperate with the transverse slots for receiving the plastic bag loops, such transverse cavities, however, being further adapted to receive intersecting handle structures of like configurations, including the notches or cavities, so they can also function as elongated blocks to be used in play by children for building structures in much the same manner as the well known "Lincoln Logs." Thus, customers continuing to purchase merchandise or food from a specific retailer, can, over a period of time, accumulate many handles which have been manufactured in accordance with these embodiments of the invention, to provide their children with a substantial number and assortment of "logs" to be used by them to build a variety of play structures.

Disc-like ends or plugs are provided to secure the open ends of the extruded handles. These plugs provide other potential adaptabilities whereby a handle can be converted into, or used as a carrier for, a flashlight, a whistle, or a dispenser of mace or the like. The possibility that a person carrying a plastic bag with a handle in accordance with the invention is, at the same time, carrying an article can be employed effectively for self defense purposes, in itself, discourages muggers from assaulting persons seen carrying bags with like handles, even though the plugs in them do not contain chemicals, such as mace and the like, which could be used effectively to counter their attacks.

The plugs may also be fashioned as connectors for interconnecting handles, end to end. for a number of purposes such as toys or extensible rods.

Further, objects and advantages of the instant invention include the circumstances that the handles cost less to manufacture than many handles designed for carrying plastic bags, serve their intended purposes both efficiently and effectively, are relatively easy to manufacture, are safe, are capable of other functions with minor modifications, are light in weight, and are easily carried by users. The invention also encourages the use of relatively inexpensive plastic bags, instead of the more expensive paper bags, and the reuse of plastic bags more often.

Other objects, adaptabilities and capabilities of the invention will be appreciated from the following description of the invention, reference being had to the accompanying drawings, in which:

DETAILED DESCRIPTION OF THE PREFERRED EMBODIMENTS

Figure 1:
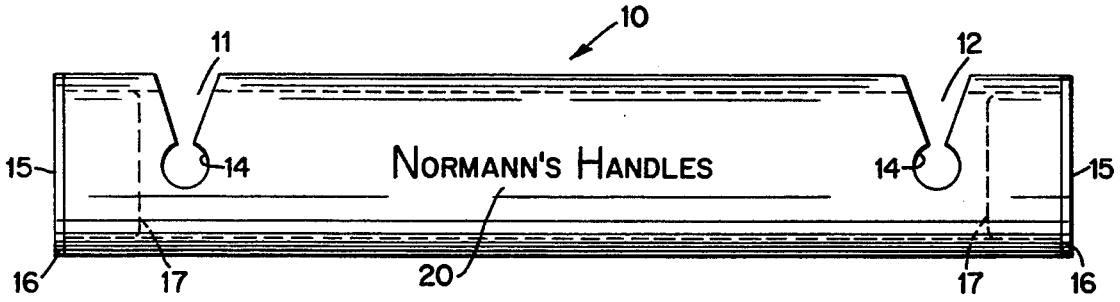
FIG. 1 is a side elevational view of the invention in a preferred and simplified form.

Referring now to FIG. 1, a handle in accordance with the invention designated generally by reference numeral 10, comprises an extruded PVC tubing which is one inch in diameter, and 5¾ inches in length. Two grooves 11 and 12 are formed to extend transversely to the longitudinal axis of handle 10. As seen in FIG. 1, grooves 11 and 12 have like V-shaped configurations, and a width of three-eighths of an inch at the greatest width of their mouths, each of which converges to form a channel, which, in its narrowest point, is one-sixteenth of an inch in width. Preferably, it should not be greater than one-eighth of an inch or at least sufficient to restrict accidental displacement of the bags' plastic loops received in grooves 11. This channel leads into a transverse opening 14, which is preferably about one-fourth of an inch in diameter. The plastic loops of plastic bags are guided and received by the two aligned openings 14 at the bottom of each of grooves 11 and 12. Each set of aligned openings 14 have a transverse axis which intersect the longitudinal axis of handle 10. A pair of end closures 15 are snugly, but slidably, received in the openings formed at ends of handle 10. Each closure comprises an outer disc 16 and an interior plug part 17. Closures 15 may comprise a variety of articles such as flashlights and whistles. As previously discussed, they may also contain chemicals, a nozzle and valve, and function to spray mace or other like chemicals to thwart intended muggings and robberies.

In addition, closures 15 may be connected to handle 10 by a threaded or bayonet type junction, or may be configured to join adjacent handles to form a rod comprising a plurality of handles 10, so secured together.

It will be further noted that ample space is provided on handle 10 between openings 14 for printing or advertising, such as "Normann's Handles" as seen in FIG. 1. Clearly this can be alternatively the name and/or logo of the merchandiser, or of other organizations and institutions, as desired. Handles in accordance with the invention may be sold or provided free at meetings and conventions of the organizations and institutions which imprint their names, logos or messages on the handles.

Figure 2:
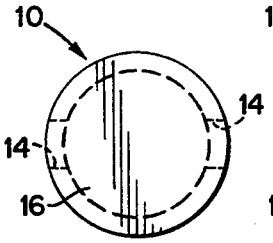
FIG. 2 is an end elevational view of the embodiment shown in FIG. 1.
Figure 3:
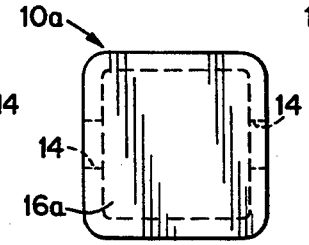
FIGS. 3, 4 and 5 are end elevational views of different further embodiments of the invention.

Referring now to FIGS. 2 and 3, it will be appreciated that although handle 10 has a circular cross section of the type indicated in FIG. 2, it can be of a substantially square cross section as shown in FIG. 3 for a handle designated 10*a*. As long as the handle is configured so it can continue to function comfortably as a handle, numerous other cross sections may be provided as will occur to one skilled in the art, for example, wedge-shaped.

Figure 4:
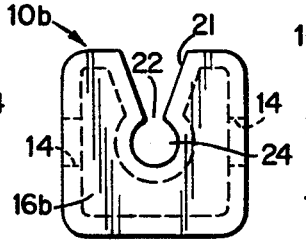
Figure 5:
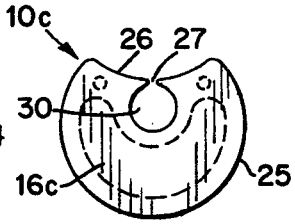

FIGS. 4 and 5 are directed to alternative embodiments which may have both the transverse grooves 11 and 12, including their circular openings 14, and a longitudinal groove 21. Thus, the extruded handle shown in FIG. 4 forms a longitudinal groove 21, which narrows into a longitudinal channel 22, and enlarges into a longitudinal circular opening 24.

Groove 21 has the same cross-section as grooves 11 and 12. However, the longitudinal axis of opening 24 coincides with longitudinal axis of handle 10 rather than intersecting it. It thus will be appreciated that handle 10*b* of FIG. 4 has a capacity for receiving the loops of the plastic bags, in grooves 11 and 12 on one hand, or in groove 21 on the other. If the loops are twisted to cross, one may be received in groove 21 and the other in groove 11 or 12. Moreover, for particularly heavy loads, bags may be provided with three carrying loops, one of which is received in each groove 11, 12 and 21.

FIG. 5 illustrates a handle 10*c* which has an arcuate outer surface 25, that is parallel to, and extends through, an arc of about 280° about the longitudinal axis of that handle. It also has an upper arcuate surface 26, which extends through an arc of about 80°, is also parallel to longitudinal axis of the handle 10*c*, and has the same radius length as surface 25, so that handles 10*c* can be conveniently stacked one on the other. In this embodiment, the groove formed by surfaces 26 converges into a channel 27, and enlarges into a substantially circular or oval opening 30, which has its longitudinal axis parallel to, and slightly higher than, the longitudinal axis which is at the center of arcuate surface 25. However, the lower part of the opening 30, which receives the bags' plastic loops, is slightly lower than the longitudinal axis of handle 10*c*, in a manner similar to openings 14 and 24, so that when handle 10*c* is being utilized to carry plastic bags wherein the loops have been received in opening 30, handle 10*c* is not urged by the weight of the bags and their contents to rotate, which would otherwise occur if the lower surface of opening 30 should be disposed above the longitudinal axis of the handle 10*c*. At the same time, if loops of another bag are received in grooves 11 and 12, they should not interfere with the loops received in opening 30 which are slightly higher.

Figure 6:
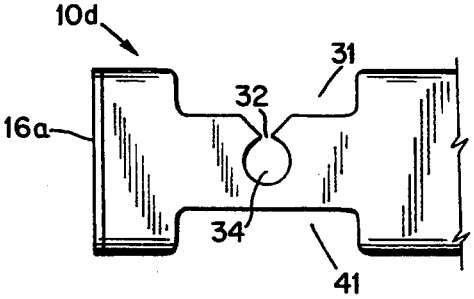
FIG. 6 is a partial side elevational view of one end of the handle which has substantially a square cross-sectional configuration, as shown in FIG. 3, and which is provided with upper and lower transverse cavities, so that handles in accordance with the invention can also be utilized as interlocking play blocks.
Figure 7:
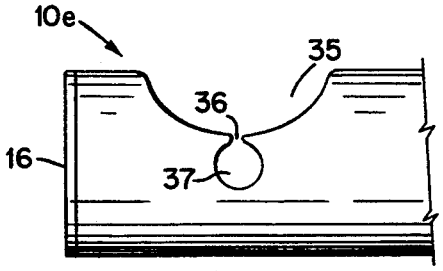
FIG. 7 is a partial side elevational view similar to FIG. 6 of one end of a handle, wherein the handle has a circular cross section as indicated in FIG. 2.

As discussed previously, handles in accordance with the invention can be readily adapted for use as elongated blocks similar to the well-known "Lincoln Logs" by providing, near their ends, transverse notches or cavities as shown in FIGS. 6 and 7. In FIG. 6, transverse cavities 31 serve the purpose not only to provide interlocking and elongated blocks, but, as in handle 10, they function as a transverse groove in a manner somewhat similar to grooves 11 and 12. This groove 31 in FIG. 6 narrows to a channel 32 and enlarges into a transverse opening 34 similar to openings 14. The cross section of the handle 10*d* in FIG. 6 is preferably the same as that for handle 10*a* shown in FIG. 3, although it can also be as shown for handle 10*b* in FIG. 4. In the alternate embodiment comprising the handle 10*e*, the transverse channel 35 is arcuate, and preferably has a radius the same as the outer radius of handle 10*e* about the longitudinal axis of handle 10*c*. As in the previous embodiments, the cavity or groove 35 narrows to a channel 36, which enlarges into an opening 37 similar to openings 14 and 34. The embodiment of FIG. 6 also has a lower transverse notch or cavity 41 which is similar in configuration to cavity 31, except that it does not include channel 32, and opening 34. The embodiment represented by handle 10*e* preferably has a cross section the same as for handle 10 shown in FIG. 2. With some modification, which requires a slight lowering of transverse channel 35 and opening 37, the cross section of the handle 10*e* in FIG. 7 can be the same as that of the handle 10*c* in FIG. 5.

The handles in accordance with the invention can have different lengths, and for the purpose of embodiments such as shown in FIGS. 6 and 7, or for certain dual purpose closures 15, the handles may be considerably longer, whereby although they still function suitably as handles, they provide longer elongated playing blocks when they are used for such purpose, or more room for dual purpose closures 15.

It will also be appreciated that the diameters or other cross-section dimensions of the handles can be somewhat greater or less than one inch, as long as the diameters or other dimensions are not so great or small to preclude the handles from functioning as such.

It will be appreciated although PVC has been disclosed as a preferred material for the handles, there are many other materials which are satisfactory, preferably materials which can be easily extruded. It is not intended, however, to preclude non-extruded materials which may be cast, carved or otherwise formed. Indeed, molded handles have advantages in that they can be formed to have a shape which distributes pressure more uniformly on the palm or fingers, or both, and thus more comfortable for a person using the handle in accordance with the invention to carry heavy loads. Extruded materials, however, are easy to work with in automated processes for forming handles in accordance with the invention, and the additional advantage of adaptability is provided, particularly as concerns providing various lengths of the handle. On the other hand, the end closure 15 is preferably molded, and may have, as discussed above, further functions which increase the attractiveness of the article in accordance with the invention. It will be understood, however, that the closure 15 should have different end configurations as shown for closures 16, 16*a*, 16*b* and 16*c* in FIGS. 2, 3, 4 and 5, respectively. Insofar as FIGS. 4 and 5 are concerned, it is important that the openings 24 and 25, as well as the grooves 21 and 26, not be blocked by disc 16.

In operation, the merchandiser is provided with a dispenser which simply may be a box of the handles located near the cash register, or, at least in the vicinity of plastic bags available to be used for receiving merchandise that the customers have purchased and paid for. The handles preferably are easily mounted on holders which may be provided therefor above the bags and used to support the bags as they are filled by placing the bags' loops in the appropriate grooves 11, 12, 21, 26, 31 or 35. When the plastic bags are sufficiently full, it being understood that the bags may also be supported at their bottoms, the salesperson lifts the bags by their attached handles, and either gives them to the customer or places them in a basket or cart being used by the customer to remove the merchandise from the store. In this connection, each handle can receive the loops of more than one bag.

Because the loops of the bags, once received in the various openings provided for the grooves, cannot be easily dislodged accidentally, the handles stay fastened to the loops of the plastic bags which can be carried without undue inconvenience, and comparably easier if the bags have heavy loads, than when they are carried manually with the loops, per se, to customers' automobiles in the parking lot. The handles then are retained in place by the loops while being transported by the automobiles, and when customers arrive home, they are still in place to be used for conveniently moving the plastic bags, together with their contents, to wherever desired in their homes or apartments.

Handles in accordance with the invention can also be carried conveniently on the person of anyone who may have use for them. Thus, they can be placed in women's handbags or men's pant or coat pockets, and then used, as necessary, to carry, purchased merchandise that has been placed in plastic bags. For handles owned by the customers, it may be worthwhile to make them somewhat sturdier, using, for example, aluminum as the extruded material and to provide closures which may double as flashlights or whistles, or for defensive purposes, such as dispensers of mace and like substances. Such handles can be used many times, and for carrying plastic bags considerably farther than would be possible or convenient, if no handles are utilized for the same purpose, particularly for carrying plastic bags which have heavy loads. Thus, the invention is uniquely advantageous to individuals who walk several blocks or farther to shop and carry their purchases home in plastic bags. In certain neighborhoods wherein robberies and the like are more common than others, handles in accordance with the invention may be carried routinely by the inhabitants that utilize closures 15 having various functions, such as a whistle, siren, mace dispenser or the like, wherein would-be attackers are less likely to attempt robbery realizing that such individuals are in a position wherein they may be able to call attention to the fact that a crime is being committed, or defend themselves, or both.

Although I have described the preferred embodiments of my invention, it is to be understood that it is capable of other adaptations and modifications within the scope of the appended claims.

Having thus disclosed my invention, what I claim is new and desire to secure by Letters Patent of the United States is:

1. A handle for lifting a bag having at least one loop, the handle comprising an elongated body which is at least about four inches in length between its ends, and a pair of transverse grooves, a said transverse groove proximate each said end of said body, each said transverse groove defined by a relatively broad mouth and converging sides extending therefrom to form a relatively narrow channel, each said transverse groove including an enlarged opening connected to said narrow channel opposite said mouth, said openings adapted to receive at least one loop of said bag, said sides of each said transverse groove converging inwardly towards the longitudinal axis of the handle as seen in side elevation so that said sides form said relatively narrow channel after extending at least about one-third of the height of the handle towards said longitudinal axis of the handle as seen in side elevation and said enlarged open of each said groove extending, at least in part, below said longitudinal axis of the handle as seen in side elevation, said body's surface between said ends being cylindrical throughout except as interrupted by said pair of transverse grooves.

2. A handle in accordance with claim 1 wherein there is an uninterrupted space for indica on the outer surface of the handle between said grooves.

3. A handle in accordance with claim 1 which is tubular throughout except as interrupted by said pair of transverse grooves and which further comprises closures received in opposite said ends of said tubular body.

4. A handle in accordance with claim 1 wherein said sides of said transverse grooves are configured for interfitting with correspondingly configured sides of transverse grooves of similar handles.

5. A handle for lifting a bag having at least one loop, the handle comprising an elongated body which is at least about four inches in length between its ends, and a pair of transverse grooves, a said transverse groove proximate each said end of said body, each said transverse groove defined by a relatively broad mouth and converging sides extending therefrom to form a relatively narrow channel, each said transverse groove including an enlarged opening connected to said narrow channel opposite said mouth, said openings adapted to receive at least one loop of said bag, said sides of each said transverse groove converging inwardly towards the longitudinal axis of the handle as seen in side elevation so that said sides form said relatively narrow channel after extending at least about one-third of the height of the handle towards said longitudinal axis of the handle as seen in side elevation and said enlarged opening of each said grooves extending, at least in part, below said longitudinal axis of the handle as seen in side elevation, said body having a substantially circular cross section throughout except where said cross section is received through said pair of transverse grooves.

6. A handle in accordance with claim 5 wherein said body is composed of a molded plastic material.

7. A handle in accordance with claim 5 wherein each said channel is about one-sixteenth of an inch in at its narrowest width measured parallel to said longitudinal axis.

8. A handle in accordance with claim 5 wherein the handle is tubular and has a radius extending from said longitudinal axis of about one-half inch.

9. A handle for lifting a bag having at least one loop, the handle comprising an elongated body which is at least about four inches in length between its ends, and a pair of transverse grooves, a said transverse groove proximate each said end of said body, each said transverse groove defined by a relatively broad mouth and converging sides extending therefrom to form a relatively narrow channel, each said transverse groove including an enlarged opening connected to said narrow channel opposite said mouth, said openings adapted to receive at least one loop of said bag, said sides of each said transverse groove converging inwardly towards the longitudinal axis of the handle as seen in side elevation so that said sides form said relatively narrow channel after extending at least about one-third of the height of the handle towards said longitudinal axis of the handle as seen in side elevation and said enlarged opening of each said grooves extending, at least in part, below said longitudinal axis of the handle as seen in side elevation, said body having a substantially square cross section throughout except where said cross section extends through said pair of transverse grooves.

* * * * *